US009558902B2

(12) United States Patent
Schmitz

(10) Patent No.: US 9,558,902 B2
(45) Date of Patent: Jan. 31, 2017

(54) TRIGGER DEVICE FOR A POWER SWITCH

(71) Applicant: EATON ELECTRICAL IP GMBH & CO. KG, Schoenefeld (DE)

(72) Inventor: Sander Schmitz, Siegburg (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/648,268

(22) PCT Filed: Nov. 29, 2013

(86) PCT No.: PCT/EP2013/075176
§ 371 (c)(1),
(2) Date: May 29, 2015

(87) PCT Pub. No.: WO2014/083189
PCT Pub. Date: Jun. 5, 2014

(65) Prior Publication Data

US 2015/0318130 A1 Nov. 5, 2015

(30) Foreign Application Priority Data

Nov. 29, 2012 (DE) ..... 10 2012 111 566

(51) Int. Cl.
*H01H 37/52* (2006.01)
*H01H 37/04* (2006.01)
*H01H 71/16* (2006.01)

(52) U.S. Cl.
CPC ..... *H01H 37/52* (2013.01); *H01H 37/04* (2013.01); *H01H 71/16* (2013.01); *H01H 2071/165* (2013.01)

(58) Field of Classification Search
CPC ..... H01H 71/16; H01H 37/04; H01H 37/52; H01H 2071/165
USPC ..... 337/380
See application file for complete search history.

(56) References Cited

U.S. PATENT DOCUMENTS 3,243,554 A * 3/1966 Malone ..... H01H 37/52 337/104
3,288,964 A 11/1966 Cataldo et al.
3,296,398 A 1/1967 Dowdle et al.
3,422,317 A 1/1969 Whiting et al.
3,715,699 A * 2/1973 Hire ..... H01H 37/5409 337/348
4,101,861 A * 7/1978 Jenne ..... H01H 11/00 29/593
4,339,740 A * 7/1982 Greenhalgh ..... H01H 37/5409 337/335
4,363,016 A * 12/1982 Unger ..... H01H 73/303 337/56
4,414,529 A * 11/1983 Yoshioka ..... H01H 37/006 337/36

(Continued)

*Primary Examiner* — Anatoly Vortman
(74) *Attorney, Agent, or Firm* — Leydig, Voit & Mayer, Ltd.

(57) ABSTRACT

A trigger device for a power switch includes a bi-metal which is arranged near to a current path of a power switch in order to control triggering, as well as a bi-metal mounting device into which the bimetal is inserted and which is designed to enclose the bi-metal, in an arrangement substantially parallel to a current path of a power switch, such that heat radiated from the current path heats the bi-metal more or less across its whole length.

12 Claims, 4 Drawing Sheets

(56) References Cited

U.S. PATENT DOCUMENTS

| | | | | |
|---|---|---|---|---|
| 4,459,572 | A * | 7/1984 | Fajner | H01H 71/524 335/16 |
| 4,546,336 | A * | 10/1985 | Petrie | H01H 73/18 335/16 |
| 4,620,175 | A * | 10/1986 | Karr | H01H 37/5427 337/343 |
| 4,795,997 | A * | 1/1989 | Fisher | H01H 37/5427 310/68 C |
| 5,191,310 | A * | 3/1993 | Obermann | H01H 89/04 337/103 |
| 5,793,026 | A * | 8/1998 | Kolberg | H01H 71/7463 335/172 |
| 6,469,610 | B1 * | 10/2002 | Chen | H01H 73/26 200/553 |
| 6,559,752 | B1 * | 5/2003 | Sienkiewicz | H01H 37/5418 337/343 |
| 6,633,222 | B2 * | 10/2003 | Nagai | H01H 37/54 337/333 |
| 8,289,124 | B2 * | 10/2012 | Hofsaess | H01H 37/5427 337/333 |
| 2006/0232905 | A1 | 10/2006 | Bradfield et al. | |
| 2013/0207768 | A1 * | 8/2013 | Lehmann | H01H 37/52 337/3 |
| 2013/0271257 | A1 * | 10/2013 | Yang | H01H 77/04 337/37 |

* cited by examiner

TRIGGER DEVICE FOR A POWER SWITCH

CROSS-REFERENCE TO RELATED APPLICATIONS

This application is a U.S. national stage application under 35 U.S.C. §371 of International Application No. PCT/EP2013/075176, filed on Nov. 29, 2013, and claims benefit to German Patent Application No. DE 10 2012 111 566.4, filed on Nov. 29, 2012. The International Application was published in German on Jun. 5, 2014, as WO 2014/083189 A1 under PCT Article 21(2).

FIELD

The invention relates to a trigger device for a power switch.

BACKGROUND

Usually, when the rated current is 630 ampere or above in the case of power switches, electronic overload trigger devices or triggers are used. Thermal or thermomagnetic triggers, which use a bimetal or a bimetal strip, have not been suitable thus far for use in such high rated currents for various reasons.

While in the case of electronic triggers the current is measured electronically and the desired trigger time can be set, the trigger time in the case of thermal triggers is determined by the temperature at the bimetal and the temperature-dependent deflection of the bimetal. In the process, the bimetal is connected to the conductor at one or more point(s). The bimetal therefore heats up primarily at this/these connection point(s). This leads to the bimetal requiring a relatively long time to reach the deflection that is normally required for triggering. The trigger times that are usually required are therefore not achievable with bimetal triggers in the case of high currents. The self-protection of the power switch is not ensured by the excessively long trigger times either, especially in the case of many times the rated current, since excessively high $I^2t$ values can occur.

A further disadvantage of bimetal triggers is that the trigger precision in the case of high currents can be influenced by external influences such as a draught or the installation position of a power switch since the bimetal is normally attached in a freestanding manner in the case of power switches. This can lead to power switches with bimetal triggers triggering at different currents because of environmental influences. When measuring the trigger time, in particular in the case of many times the rated current, this becomes noticeable in varying trigger times.

U.S. Pat. No. 3,288,964 discloses a relay which comprises a U-shaped molded bimetal which is arranged substantially in parallel with a U-shaped molded portion of a current path of the relay.

U.S. Pat. No. 3,296,398 A discloses a safety switch having thermal overcurrent protection, in which a bimetal trigger is arranged substantially in parallel with a resistance heater and in a housing of the safety switch together with said heater.

US 2006/0232905 A1 also describes a thermal overcurrent protection device, in which a bimetal switch either is embedded in a conductor portion which has high electrical resistance and through which electric current flows or is sealed in together with resistance wires through which electric heating current flows.

U.S. Pat. No. 3,422,317 A relates to a thermal overcurrent protection device comprising bimetals which are U-shaped and arranged substantially in parallel with current paths. In order to compensate ambient influences, a separate U-shaped bimetal is provided which is exposed to the ambient temperature. An arm of this separate bimetal is coupled to arms of the bimetals, which are assigned to the current paths, via a lever, in order to compensate the influence of the ambient temperature on the trigger mechanism of the bimetals assigned to the current paths using the effect of the lever.

SUMMARY

An aspect of the invention provides a trigger device for a power switch, the device comprising: a bimetal, arranged near to a current path of a power switch, in a configuration so as to control triggering of the power switch; and a bimetal mounting device into which the bimetal is inserted, wherein the bimetal mounting device is configured to enclose the bimetal in an arrangement substantially parallel to a current path of the power switch such that heat radiated by the current path can heat the bimetal almost across a whole length of the bimetal, and such that the bimetal is shielded from one or more ambient influences, wherein the bimetal mounting device is configured to fully encloses the current path and the bimetal, wherein the current path and bimetal can be accommodated in a common housing formed by the bimetal mounting device, and wherein the bimetal mounting device includes a base on which the bimetal is attached at a foot thereof.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
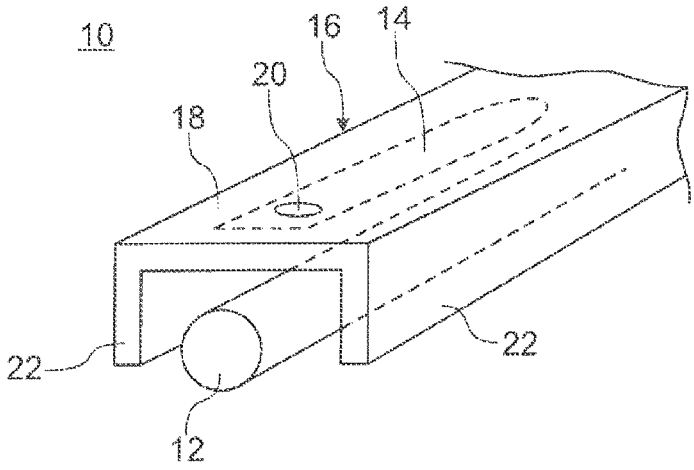
FIG. 1 is a sketch of a perspective view of a first embodiment of a bimetal trigger device according to the invention.

An aspect of the present invention is therefore to propose an improved trigger device for a power switch which does use a bimetal but its disadvantage of too much dependence on ambient influences or environmental influences described at the outset is reduced.

One idea underlying the present invention is to provide a mounting device for the bimetal of a trigger to be arranged substantially parallel to a current path of a power switch, which mounting device is designed such that heat radiated by the current path can heat the bimetal almost across its whole length and can shield the bimetal from ambient influences. The deflection of the bimetal is achieved by the heat radiated by the current path and, if applicable, also by the heating of a fixing point of the bimetal to the current path. As a result of the shielding from environmental influences by the bimetal mounting device, the bimetal is mostly within the heat radiation such that external influences on the heating and deflection of the bimetal are reduced. Above all, the influence of the ambient temperature and the effects from draughts can be reduced by the mounting device.

One embodiment of the invention relates to a trigger device for power switches comprising a bimetal, which is provided to be arranged near to a current path of a power switch in order to control triggering of the power switch, as well as to a bimetal mounting device into which the bimetal is inserted and which is designed to enclose said bimetal in an arrangement substantially parallel to a current path of the power switch, such that heat radiated by the current path can heat the bimetal almost across its whole length and the bimetal is shielded from ambient influences. The current path can also be formed by shunts within the meaning of the present invention.

The bimetal mounting device can have a base on which the bimetal is fixed at a foot and which is bounded by two side walls, which extend substantially parallel to the bimetal and are constructed such that the bimetal is shielded from ambient influences. As a result of this, a kind of pocket is formed for the bimetal in which the heat radiating from the current path transfers to the bimetal and thus can bring about more rapid heating of the bimetal, as a result of which the triggering of the power switch can be accelerated.

The bimetal can be fixed to the base such that its active side is facing the current path. As a result of this the heating and therefore the deflection of the bimetal by the heat radiated by the current path and ultimately the triggering can be accelerated again.

Furthermore, the side walls can be designed such that they extend at least partly beyond the bimetal. As a result of this, the pocket-like receptacle for the bimetal formed by the base and the side walls can concentrate the heat radiated by the current path even more efficiently onto the bimetal such that as rapid and defined heating of the bimetal as possible and an even better shielding from ambient influences is ensured.

The bimetal mounting device can be designed to fully enclose the bimetal, in particular it can be designed as a pocket, sleeve or tube into which the bimetal is introduced. This results in very constant and rapid heat radiation onto the bimetal. "Fully enclose" here does not mean a hermetic decoupling of the bimetal from its surroundings. On the contrary, there are still openings, for example for a pivot or pin of the trigger device that can be moved by the bimetal and for introducing the bimetal into the pocket, sleeve or tube.

The bimetal mounting device can also be formed by the current path itself. In this case, the bimetal is coupled to the current path at at least one fixing point such that the heat transfer from the current path onto the bimetal is particularly efficient. This has the advantage that the bimetal heats up more rapidly and as a result, the required deflection can be achieved earlier, in particular about 30% earlier in comparison to the conventional use of the bimetal without the mounting device described at the outset.

Ultimately, the bimetal mounting device can have an L, U, O, circular or spline shape. Such shapes can have advantages in terms of manufacturing and can also facilitate the concentration of the heat around the bimetal.

A further embodiment relates to a power switch, in particular for high rated currents, with at least one current path and a trigger device according to the invention and, as described therein, per current path, the trigger device assigned to a current path being arranged in relation to the current path such that the bimetal of the trigger device lies substantially parallel to the current path at a predefined distance therefrom and can be heated up by the heat radiated by the current path.

Further advantages and possible applications of the present invention will emerge from the description below in conjunction with the embodiments shown in the drawings.

In the following description identical, functionally identical and functionally related elements can be provided with the same reference numerals. Absolute values are only given by way of example hereinafter and are not to be understood to limit the invention.

Figure 2:
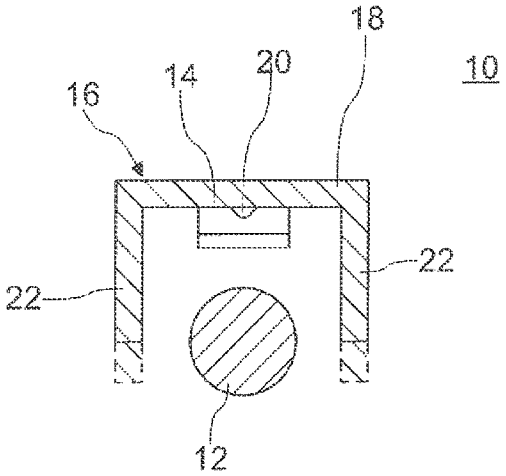
FIG. 2 is a sectional view of the bimetal trigger device shown in FIG. 1.

In the embodiment of the invention shown in FIGS. 1 and 2, the bimetal mounting device is designed as a separate element to which the bimetal is fixed and which is mounted over the current path. In this embodiment, the bimetal is efficiently shielded from ambient influences such as draughts such that the heat radiated by the current path can act almost unimpeded on the bimetal. As a result of this, the required trigger time of the power switch trigger device can be better adhered to since ambient influences and environmental influences have less influence on the heating of the bimetal and thus the triggering as a result of the shielding of the bimetal.

The trigger device 10 shown in FIG. 1 for a power switch comprises a bimetal 14 in the form of a strip, which is arranged substantially parallel to a current path 12 of the power switch. In the process, the distance between current path 12 and bimetal 14 is measured such that the heat developed when the rated current of the current path 12 is exceeded and radiated by the current path 12 generates a deflection of the bimetal within a predetermined time span such that a triggering in the power switch can take place within a defined period of time.

The bimetal 14 is fixed at a foot 20 on a base 18 of a mounting device 16 for the bimetal 14. In the embodiment shown in FIG. 1, the mounting device 16 is designed as a separate component. It can, however, also be formed by the current path itself as in the embodiment shown in FIG. 3.

The mounting device 16 also comprises two side walls 22, which together with the base 18 form a kind of pocket for the bimetal 14. For this purpose, the side walls 22 extend over the bimetal 14, as can be seen in FIG. 2. They can also at least partly extend beyond the current path 12 (dashed extensions of the side walls 22 in FIG. 2) such that the current path 12 and the bimetal 14 can be almost totally covered by the mounting device. In the longitudinal direction, the side walls 22 can extend beyond the length of the deflected bimetal 14. It is also feasible for the mounting device to be fully closed, i.e. on all sides such that the current path 12 and the bimetal 14 are accommodated in a common housing. For example, the mounting device 16 can have a pocket, a tube or a sleeve for this purpose which encloses the current path 12 and the bimetal 14.

The mounting device 16 achieves two objects: firstly it brings about a distribution of the heat radiated by the current path 12 across almost the whole length of the bimetal 14 since the radiated heat develops inside the space created by the base 18 and the side walls 22 of the mounting device 16 and therefore can heat up the bimetal 14 that is located inside the space relatively evenly. Secondly, the mounting device 16 forms a kind of shielding of the bimetal 14 from ambient influences such as draughts or the ambient temperature.

Figure 4:
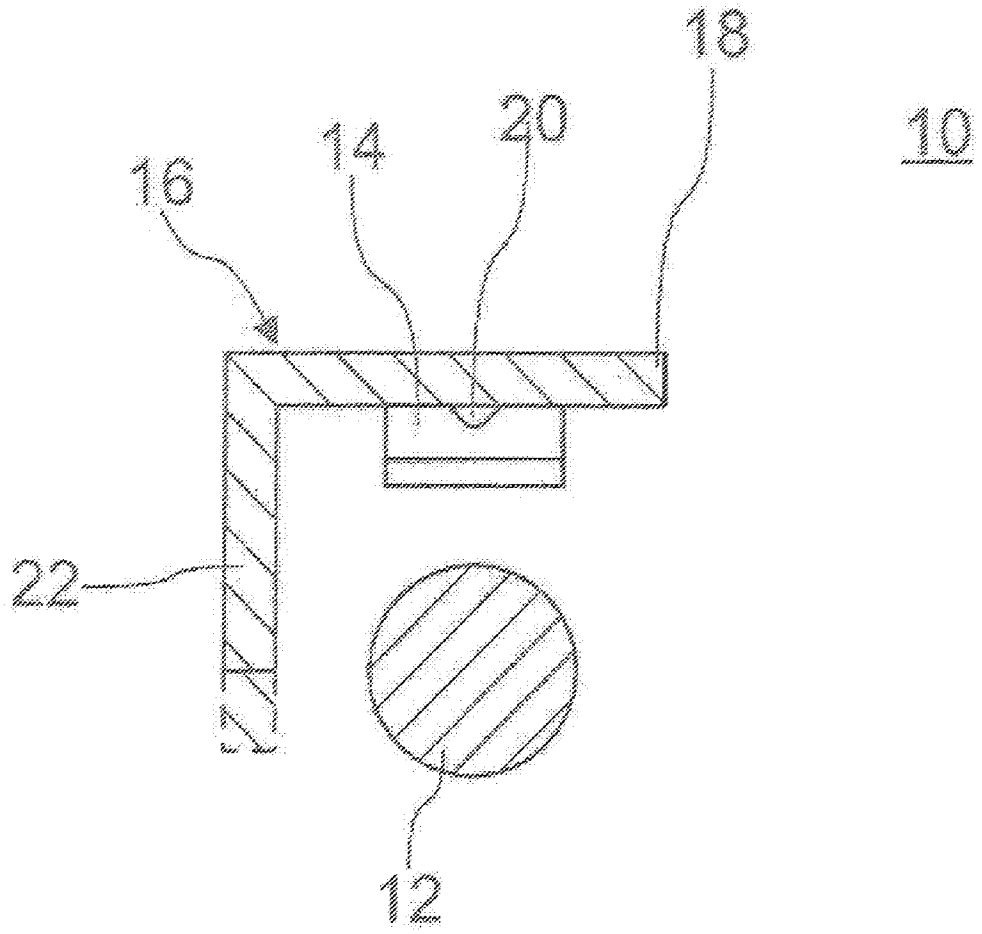
FIG. 4 is a sectional view of a third embodiment of a bimetal trigger device.
Figure 5:
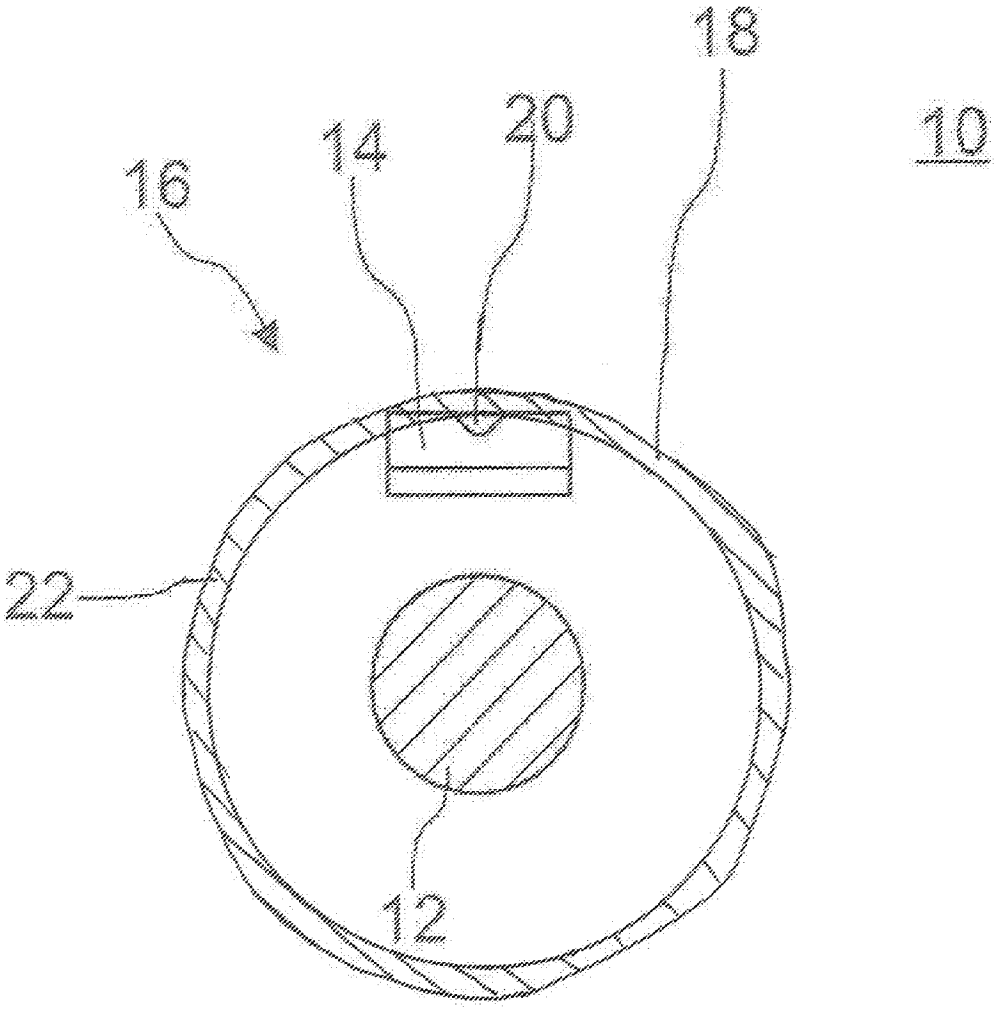
FIG. 5 is a sectional view of a fourth embodiment of a bimetal trigger device.

As shown in FIG. 2, the bimetal mounting device 16 has a U-shaped cross section. It can, however, also have other cross sectional forms, such as an L, O, circular, tube, sleeve or spline shape. The L cross section shape is shown in FIG. 4, while the O, circular, tube or sleeve cross section shape is shown in FIG. 5. The shape of the mounting device can be selected in the process depending on the field of application and adapted to the conditions of the application.

A further modification of the embodiment shown in FIGS. 1 and 2 can consist in using the mounting device 16 itself as a current path. The current path 12 in this case can be a shunt, which can serve to reduce the dimensions of the mounting device.

In the case of the embodiment of the invention described below, the bimetal mounting device can be formed by the current path itself, i.e. not as a separate element. In the process, the bimetal is fixed directly to the current path at at least one point, as a result of which a relatively rapid heating of the bimetal and thus a short trigger time of the trigger device can be achieved.

Figure 3:
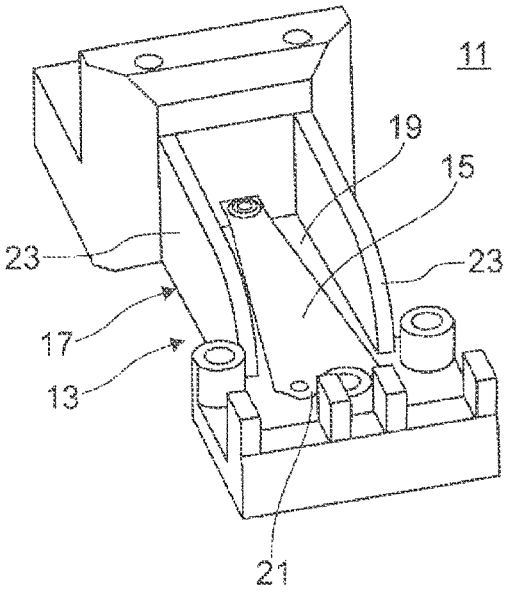
FIG. 3 is the perspective view of a second embodiment of a bimetal trigger device according to the invention.

FIG. 3 shows a further embodiment of the trigger device 11 according to the invention in which the bimetal mounting device 17 is formed by the current path 13 of a power switch and therefore the current path 13 forms part of the trigger device. In other words, in this embodiment the bimetal mounting device 17 is an integral component of the current path 13.

For this purpose, the current path 13 is formed such that it forms a kind of pocket for the bimetal 15, which is fixed directly by means of a foot 21 to the current path 13 on a base 19 of the mounting device 17, which is formed by a specially designed segment of the current path 13.

The bimetal 15 is arranged substantially parallel to the current path 13 and so as to be suspended above it. Firstly, it is heated via the foot 21 and secondly, almost across its whole length by the heat radiated by the current path 13.

The side walls 23 of the base 19, which are likewise formed by a special design of the current path 13, shield the bimetal 15 from ambient influences such as draughts such that relatively defined heating by the heat radiated by the current path 13 can take place.

The shown trigger device 11 with the current path 13 can, for example, be designed as a segment of a current path of a power switch, as a result of which it can be installed in the power switch with relatively little assembly effort. In particular, the shown trigger device 11 can already be pre-assembled, as a result of which it only has to be installed in the power switch for assembly.

As distinct from the embodiment shown in FIGS. 1 and 2, assembly can be simplified as a result. However, such a trigger device 11 is less suitable for retrofitting since it requires the replacement of at least part of an already existing current path whereas the trigger device shown in FIGS. 1 and 2 can normally be retrofitted in an existing power switch without modifying the current path.

The present invention is especially suitable for use in power switches with thermal triggers and can bring about a reduction in trigger times and the ambient influences and environmental influences, especially in the case of thermo-magnetic power switches for rated currents of 250 ampere or higher. Furthermore, a cost-effective alternative to commercially available electronic overload triggers for power switches for rated currents of 630 ampere or higher is provided by the invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

10 Trigger device
11 Trigger device
12 Current path of a power switch
13 Current path of a power switch
14 Bimetal (strip)
15 Bimetal (strip)
16 Bimetal mounting device
17 Bimetal mounting device
18 Base of the bimetal mounting device 16
19 Base of the bimetal mounting device 17
20 Foot
21 Foot
22 Side walls of the bimetal mounting device 16
23 Side walls of the bimetal mounting device 17

The invention claimed is:

1. A trigger device for a power switch, the device comprising:

a bimetal, arranged near to a current path of a power switch, in a configuration so as to control triggering of the power switch; and a bimetal mounting device into which the bimetal is inserted, wherein the bimetal mounting device encloses the bimetal in an arrangement substantially parallel to a current path of the power switch such that heat radiated by the current path can heat the bimetal almost across a whole length of the bimetal, and such that the bimetal is shielded from one or more ambient influences, wherein the bimetal mounting device fully encloses the current path and the bimetal, wherein the current path and bimetal is accommodated in a common housing formed by the bimetal mounting device, and wherein the bimetal mounting device includes a base and the bimetal includes a foot, the bimetal being attached directly to the base by the foot.

2. The device of claim 1, wherein the base is bounded by a first and second side wall, wherein the first and second side walls extend substantially parallel to the bimetal, and wherein the first and second side walls shield the bimetal from the one or more ambient influences.

3. The device of claim 2, wherein the bimetal is fixed to the base such that an active side of the bimetal is facing the current path.

4. The device of claim 2, wherein the side walls at least partly extend beyond the bimetal.

5. The device of claim 1, wherein the bimetal mounting device is a pocket.

6. The device of claim 1, wherein the bimetal mounting device has an L shape.

7. A power switch, comprising:

a current path; and the trigger device of claim 1 wherein the trigger device is arranged relative to the current path such that the bimetal of the trigger device lies at a predetermined distance substantially parallel to the current path, and wherein the bimetal can be heated by the heat radiated by the current path.

8. The device of claim 1, wherein the bimetal mounting device is configured as a sleeve into which the bimetal is introduced.

9. The device of claim 1, wherein the bimetal mounting device is a tube into which the bimetal is introduced.

10. The device of claim 1, wherein the bimetal mounting device has a U shape.

11. The device of claim 1, wherein the bimetal mounting device has a circular shape.

12. The power switch of claim 7, adapted for high rated currents.

* * * * *